United States Patent [19]

Murata et al.

[11] Patent Number: 4,983,943

[45] Date of Patent: Jan. 8, 1991

[54] MAGNETIC CORE AND METHOD OF MANUFACTURING SAME

[75] Inventors: Shinichi Murata; Yoshiyuki Yamauchi; Takao Kusaka; Takao Sawa; Noriaki Yagi, all of Tokyo, Japan

[73] Assignee: Kabushiki Kaisha Toshiba, Kawasaki, Japan

[21] Appl. No.: 429,067

[22] Filed: Oct. 25, 1989

[30] Foreign Application Priority Data

Nov. 2, 1988 [JP] Japan ..... 63-278388

[51] Int. Cl.[5] ..... H01F 27/24

[52] U.S. Cl. ..... 336/213; 29/605; 336/234

[58] Field of Search ..... 336/213, 233, 234; 29/605, 609; 148/403, 404; 428/636

[56] References Cited

U.S. PATENT DOCUMENTS 4,847,987 7/1989 Ballard ..... 336/234 X

*Primary Examiner*—Thomas J. Kozma

*Attorney, Agent, or Firm*—Foley & Lardner, Schwartz, Jeffery, Schwaab, Mack, Blumenthal & Evans

[57] ABSTRACT

A magnetic core has a wound-up laminated body of thin metal tape which has rolled face and free face (unrolled face) wherein rolled faces or free faces of the thin metal tape are arranged adjacently facing each other in at least a part of said wound-up laminated body.

8 Claims, 3 Drawing Sheets

Amorphous alloy thin tape width

Difference of sheet thickness of amorphous alloy thin tape

MAGNETIC CORE AND METHOD OF MANUFACTURING SAME

BACKGROUND OF THE INVENTION

This invention relates to laminated magnetic cores produced by winding up thin metal tape, and to a method of manufacturing these.

Recently, amorphous thin metal magnetic tapes have attracted attention as materials for constructing the magnetic cores of transformers and magnetic cores of magnetic amplifiers, on account of their very superior magnetic properties.

Such magnetic cores fabricated from amorphous thin metal tapes are produced by winding up thin metal tape into the required shape. Depending on the application, such magnetic cores may be toroidal cores or cut cores.

For example, cut cores employing amorphous thin metal tapes are manufactured as follows.

The amorphous thin metal tape is first laminated by winding up to the desired shape on a winding jig. Next, it is subjected to heat treatment below the crystallization temperature, in order to remove strain in the amorphous thin metal tape and to obtain good magnetic properties. It is then cut at the appropriate places to produce a cut core shape.

However, when such cutting is carried out, if the layers in the wound-up body were not fixed, the cutting produces distortion of the thin tape at the cut face, or loss of the shape of the wound up body. The gaps between the layers of the wound-up body are therefore impregnated with an epoxy resin or the like, and the cutting is only performed after the wound-up body has been fixed by hardening the resin.

However, if the amorphous thin metal tape is fixed by resin impregnation as described above, the internal stress of the amorphous thin metal tape is increased due to distortion of the amorphous thin metal tape by contracting forces generated when the resin is hardened. This increases the core loss of the magnetic core that is obtained. There is a particular problem with epoxy resin due to its large contraction rate on hardening.

Accordingly, countermeasures are adopted, such as decreasing the contraction rate on hardening by changing the type of resin used for the impregnation. Some degree of success has been obtained with amorphous thin metal tapes of comparatively small width. However, in the case of magnetic cores employing amorphous thin metal tape of larger width, sufficient reduction of distortion has still not been obtained. Reducing the core loss of wound magnetic cores is therefore considered an urgent task.

As described above, magnetic cores employing a wound-up body consisting of amorphous thin metal tape are subject to the problem of increased core loss, caused by forces of contraction, etc., that are produced during hardening of the impregnating resin. Furthermore, there is the problem that low core loss, in particular when wide amorphous thin metal tape is used, cannot be obtained simply by decreasing the force of contraction of the resin.

SUMMARY OF THE INVENTION

In connection with the problems discussed above, the inventors made a series of investigations regarding the shape of the amorphous thin metal tape itself. As a result, they discovered that one cause of increased core loss is attributable to deformation of shape, e.g., the cross-sectional shape in the direction of lamination of the wound body becomes trapezoidal. This occurs because there is considerable fluctuation of sheet thickness in the width direction of amorphous thin metal tape manufactured by the super-quenching method employing a single roll, which is the normally used method of manufacturing amorphous thin metal tapes. In the conventional super-quenching single roll manufacturing method, the thin film has a rolled side or face formed adjacent the quenching roll and a free face on the other side thereof. In this method, liquid amorphous metal is spread over a cold quenching roll to solidify the liquid thus forming the film.

Specifically, the inventors inferred that, when differences are created between the sheet thicknesses at both ends in the width direction of amorphous thin metal tape, upon winding up the film, there occurs stress which is concentrated in regions of small sheet thickness. This causes very large stresses to be applied, or results in the stress being unevenly distributed over the whole wound body. As a result, core loss is increased. Also, if such distorted shapes occur, the resin is unable to effect sufficient insulation between the layers, which also increases core loss.

It is believed that such increased core loss due to sheet width fluctuation in the width direction of amorphous thin metal tape occurs not only in cut cores but also in toroidal cores etc., in the same way.

An object of the invention is to provide a magnetic core realizing low core loss, and a method of manufacturing same, by compensating for the fluctuation in sheet thickness in the width direction of thin metal tape formed by the single roll method.

The invention is directed to a magnetic core having a wound-up laminated body of thin metal tape which has a rolled face and a free face (unrolled face) wherein the rolled faces or free faces of said thin metal tape are arranged adjacently facing each other in at least a part of the wound-up laminated body.

The invention is also directed to a method of manufacturing the magnetic core comprising the steps of:

forming thin metal tapes having a rolled face and a free face; winding up and laminating the thin metal tapes into a desired shape on a winding jig; and winding up and laminating at least two of the thin metal tapes in the condition that rolled faces or free faces of the at least two thin metal tapes are superimposed opposite each other.

DETAILED DESCRIPTION OF THE PREFERRED EMBODIMENTS

Figure 1:
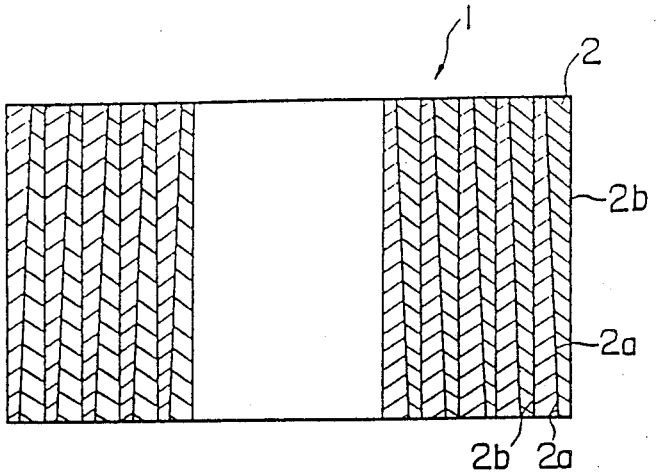
FIG. 1 is a sectional view of a cut core constituting an embodiment of the invention.

The thin metal tape used in the invention is formed by the super-quenching method using a single roll. The invention is most applicable if the difference in sheet thickness of the two ends in the width direction of the thin metal tape is, on average, at least approximately 2 μm. It is further effective if the width of the thin metal tape is at least 10 mm, and thickness 10 μm to 50 μm and if the number of wound-up layers is at least 50. There is no particular restriction regarding the material of the metal tape, but, for example, the following are effective:

Fe-based amorphous alloy of large magneto-striction represented by the general formula: $Fe_a M_b Y_c$ where, in this formula, M is at least one element selected from the group Ti, V, Cr, Mn, Co, Ni, Zr, Nb, Mo, Hf, Ta, W, Re, Ga, Ru, Rh, Pd, Os, Ir, Pt, and rare earth elements, Y is at least one element selected from the group of Si, B, P, and C, and a, b, and c indicate numbers satisfying the relationships $65 \leqq a \leqq 85$, $0 \leqq b \leqq 15$, $5 \leqq c \leqq 35$;

or Co-based amorphous alloy whereof the absolute value of the magnetostriction constant is not more than $2 \times 10^{-6}$, represented by the general formula: $Co_x M'_y Y_z$ where, in this formula, M' is at least one element selected from the group consisting of Ti, V, Cr, Mn, Fe, Ni, Zr, Nb, Mo, Hf, Ta, W, Re, Ga, Ru, Rh, Pd, Pt, and rare earth elements, and Y is at least one element selected from the group consisting of Si, B, P and C, and x, y, and z respectively indicate numbers satisfying $65 \leqq x \leqq 80$, $0 \leqq y \leqq 15$, $10 \leqq c \leqq 35$.

It is also effective to use soft magnetic thin metal tape consisting of a soft magnetic alloy having fine crystal grains of about 50 Å to 300 Å expressed by the general formula:

$$(Fe_{1-m}, X_m)^{100-n-p-q-r} Cu_n M''_p Si_q B_r$$

where, in this formula, X is at least one element selected from the group Ni and Co, and M'' is at least one element selected from the group Nb and Mo, and m, n, p, q, and r are numbers satisfying respectively $0 \leqq m \leqq 0.3$, $0.1 \leqq n \leqq 5$, $0.1 \leqq p \leqq 5$, $5 \leqq q \leqq 25$, $3 \leqq r \leqq 15$, $15 \leqq q+r \leqq 30$.

The magnetic core of the invention is manufactured for example as follows.

Thin metal tape consisting of a material as described above is initially manufactured using the single roll method. Next, a wound-up body is manufactured by taking at least two thin metal tapes obtained from the same forming lot, superimposing their rolled faces on one another or their free faces on one another, and winding them up on a winding jig, in this condition, to form a magnetic core of the required shape. It should be noted that it is not necessarily essential that the entire wound-up body should be of the above-described two-layer winding, so long as the major portion is wound by this method.

A toroidal core is obtained by performing heat treatment for strain removal and improvement of magnetic properties of the wound-up body. Also, in the case of a cut core, after carrying out heat treatment for strain removal and improvement of magnetic properties on the wound-up body that is obtained, it is impregnated with epoxy resin or inorganic polymer and a hardening treatment is carried out to effect fixing between the layers of the wound-up body. If an inorganic polymer is used, heat treatment and hardening treatment can be performed simultaneously in order to improve the properties. After this, a cut core is obtained by cutting to the required final shape.

In general, the difference in sheet thickness of the two ends in the width direction of thin metal tape obtained using the single roll method is about 5 μm. It is therefore possible to compensate for this difference in sheet thickness, so far as the overall wound-up body is concerned, by carrying out winding-up lamination in such a way that thin metal tapes from the same forming lot are superimposed, with corresponding rolled faces, or corresponding free faces, facing each other. As a result, a wound-up body is obtained in which the stress is applied practically uniformly, and the increased core loss caused by non-uniformity of stress or very large locally applied stress can be prevented. Also, when resin is impregnated between the layers of the wound-up body, satisfactory permeation of the resin between the layers can be achieved. This also helps to prevent increase in core loss.

EMBODIMENT 1

Amorphous alloy thin tape of width 50 mm and having an alloy composition expressed by:

$$(Fe_{0.97}, Cr_{0.03})_{79} Si_{10} B_{11}$$

was manufactured by the single roll method. Although fluctuation was seen in the sheet thickness at the two end regions in the width direction of the amorphous alloy thin tape obtained, the mean values obtained were practically 18 μm and 23 μm at the respective ends.

Next, a wound-up body was manufactured by cutting this amorphous alloy thin tape into two in the length direction to form two equal width strips, each half the original width, and placing the rolled faces against each other (or the free faces against each other), and then winding up these two tape layers to the required shape on a winding jig to a winding layer thickness of 20 mm.

Next, this wound-up body was subjected to heat treatment at a temperature of 420° C., for 80 minutes. It was then impregnated with epoxy resin, and hardening treatment carried out, thereby fixing the wound-up body.

After this, a rectangular cut core for high frequency transformer use was obtained by dividing this wound-up body, with layers fixed by resin, by cutting from prescribed positions.

FIG. 1 is a view showing the cross-section in the direction of lamination of the cut core thus obtained. As can be seen from this figure, in the wound-up body 1 that is obtained, the rolled faces 2a and free faces 2b of the amorphous alloy thin tape 2 are arranged adjacent each other. The result is that the thickness of the wound-up layers at the two ends in the width direction of the thin tape is practically equal. Consequently, the stress distribution of the wound-up body as a whole is also practically uniform.

It is also noted in FIG. 1 that the arrangement of the two-layer film before rolling is such as to obtain a substantially rectangular cross-section for the superimposed two layers. It is possible to obtain a substantially rectangular cross-section in some cases where the free face of the first film is superimposed on the rolled face of the second film to form the two-layer film which is subsequently rolled. In other cases, it is possible to utilize more than two films which are oriented such that the cross-sectional area of the film composition (before rolling) is of a substantially rectangular cross-sectional area.

Next, using a rectangular cut core for radio frequency transformer use obtained in the manner described above, the core loss was determined under the measurement conditions shown in Table 1. The results are shown in Table 1.

Also, for comparison with the invention, a rectangular cut core for transformer use was obtained by manufacturing a wound-up body of the same shape by single-layer winding, using the same amorphous alloy thin tape manufactured in Embodiment I.

Figure 2:
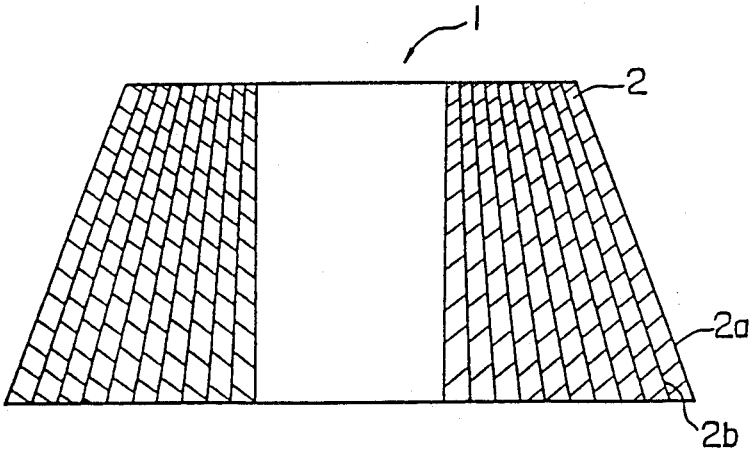
FIG. 2 is a cross-sectional view of a cut core manufactured according to a comparative example.

FIG. 2 is a view showing the cross-section in the direction of lamination of the cut core of Comparative Example 1 that was thus obtained. As can be seen from this figure, in the wound-up body 1 that was obtained, rolled faces 2a and free faces 2b of the amorphous alloy thin tape 2 are arranged adjacently facing each other. As a result, the wound-up layer thickness at the two end regions in the width direction of the thin tape is considerably different. The result is that stress is concentrated on the side of smaller sheet thickness in the width direction of the thin tape.

The core loss was determined under the same conditions as in Embodiment 1 for the rectangular cut core for transformer use of this comparative Example 1. The results are also shown in Table 1.

TABLE 1

| | Core loss (W/kg) | |
|---|---|---|
| Measurement conditions | f = 1 kHz, B = 0.8 T | f = 10 kHz, B = 0.2 T |
| Embodiment 1 | 15.0 | 23.2 |
| Comparative Example 1 | 19.4 | 30.2 |

As is clear from the results of Table 1, the core loss of the magnetic core of this embodiment is reduced by about 30%. Also, since, for the magnetic core of Embodiment 1, two layers of tape were wound up simultaneously, the winding-up time for forming the wound-up body can be reduced.

EMBODIMENT 2

Amorphous alloy thin tape of the alloy composition:

$$Fe_{73.5}Cu_{1.5}Nb_{3.0}Si_{15.5}B_{6.5}$$

was manufactured by the single roll method as a sample of width 25 mm. The sheet thicknesses at the two ends in the width direction of the amorphous alloy thin tape obtained were respectively about 21 μm and 25 μm on average, though there was some fluctuation.

Next, a wound-up body was manufactured by cutting this amorphous alloy thin tape into two in the length direction, placing rolled faces (or free faces) on top of each other, and winding up the resulting two tape layers together on a winding jig to the required shape to give a wound-up layer thickness of 20 mm.

Next, this wound-up body was subjected to heat treatment at a temperature of 550° C. higher than the crystallization temperature of this alloy thin tape, for 60 minutes in a nitrogen atmosphere. It was then impregnated with epoxy resin and hardening treatment performed, to obtain a fixed wound-up body.

After this, a rectangular cut core for high frequency transformer use was obtained by cutting this wound-up body, that had been fixed by means of resin between the layers, into two, from prescribed positions.

The core loss of this cut core was determined under the measurement conditions shown in Table 2.

Also, using an amorphous alloy thin tape manufactured in above Embodiment 2, a wound-up body was manufactured of the same shape, but by winding up a single tape layer. This was then subjected to heat treatment under the same conditions, to produce a rectangular cut core for high frequency transformer use (Comparative Example 2). The core loss of this cut core was likewise evaluated. The results are shown in Table 2.

TABLE 2

| | Core loss (mW/cc) | |
|---|---|---|
| Measurement conditions | f = 50 kHz, B = 3 kG | f = 100, kHz, B = 2 kG |
| Embodiment 2 | 340 | 480 |
| Comparative Example 2 | 390 | 560 |

As is clear from the results of Table 2, the core loss of the magnetic core of this embodiment was reduced by about 15%.

EMBODIMENT 3

Amorphous alloy thin tape of the alloy composition represented by:

$$[(Co_{0.95}Fe_{0.05})_{0.96}Cr_{0.04}]_{74}Si_{14}B_{12}$$

was manufactured by the single roll method as a sample of width 20 mm. The sheet thickness at the two ends in the width direction of the amorphous alloy thin tape that was obtained were on average 18 μm and 22 μm respectively, though fluctuations were observed.

Next, this amorphous alloy thin tape was divided into two in the longitudinal direction, and rolled faces (or free faces) were placed on top of each other, and a wound-up body of external diameter 600 mm × internal diameter 400 mm × height 40 mm was manufactured by winding up these two tape layers simultaneously on a winding jig, to the required shape.

Next, a toroidal core was manufactured by performing heat treatment on this wound-up body under the conditions 430° C., 40 minutes.

Also, as Comparative Example 3, a toroidal core was manufactured by producing a wound-up body of the same shape, but by winding up a single tape layer, using the amorphous alloy thin tape described above, and carrying out heat treatment under the same conditions.

The respective core losses were measured using the toroidal cores of Embodiment 3 and Comparative Example 3. The results are shown in Table 3.

TABLE 3

| | Core loss (mW/cc) | |
|---|---|---|
| Measurement conditions | f = 50 kHz, B = 0.3 T | f = 100 kHz, B = 0.2 T |
| Embodiment 3 | 280 | 370 |
| Comparative Example 3 | 370 | 500 |

As is clear from the results of Table 3, the core loss of the toroidal core of this embodiment was reduced by about 15%. The dimensional accuracy of the toroidal core of Embodiment 3 was excellent. However, in the case of the toroidal core of Comparative Example 3, although the tape was closely wound on one side in the width direction of the amorphous alloy thin tape, on the other side, it appeared rather loose.

EMBODIMENT 4

Amorphous alloy thin tape having the alloy composition represented by $Fe_{78}Si_9B_{13}$ was manufactured as a sample of width 50 mm by the single roll method.

Next, this amorphous alloy thin tape was cut in the longitudinal direction so as to provide a number of different widths, to produce amorphous alloy thin tapes of various different widths. Next, these amorphous alloy thin tapes were divided into two in the longitudinal direction and rolled faces (or free faces) were placed on top of each other. Respective wound-up bodies were produced by winding up these two tape layers simultaneously to the required shape on a winding jig, the ratio between width and thickness of the wound-up layers in each case being 1:1.

Next, toroidal cores were manufactured by heat treatment of these wound-up bodies under the conditions 400° C., 2 hours, followed by resin moulding.

Also, toroidal cores were manufactured in the same way as above, using the amorphous alloy thin tapes of the various different widths used in the above embodiment, except that the wound-up bodies were formed by winding up these amorphous alloy thin tapes from a single tape layer only.

Figure 3:
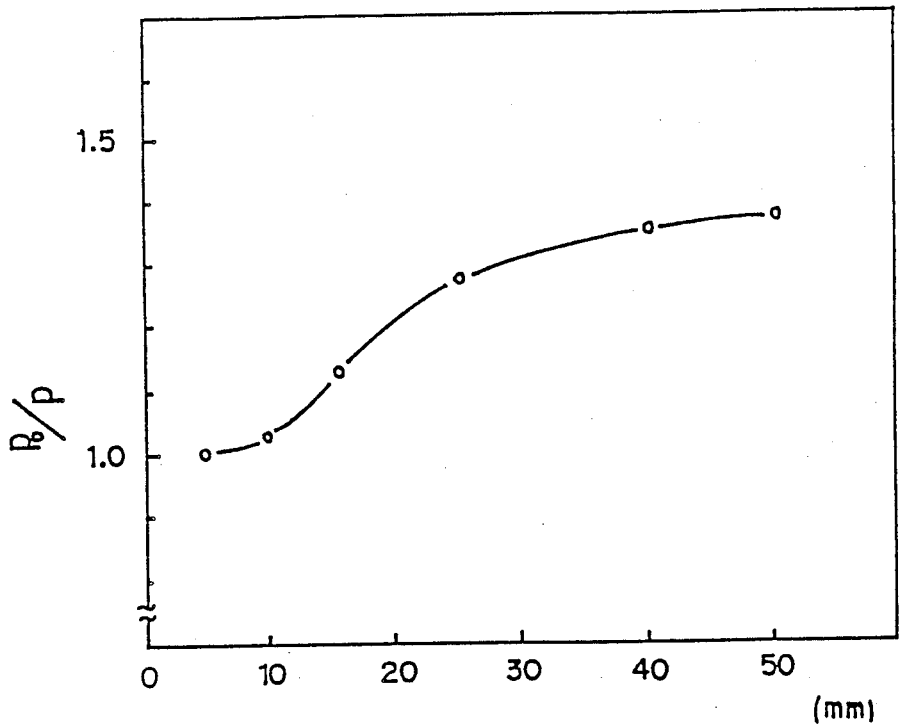
FIG. 3 is a graph showing the relationship between the width of the amorphous alloy thin tape of a toroidal core manufactured according to an embodiment of the invention and the core loss ratio of toroidal cores manufactured by winding a single tape layer using thin tape of the same width.

The core loss under the conditions f=10 kHz, B=0.3 T was measured in each case for the toroidal cores of the embodiment and of the comparative example. The results are shown in FIG. 3, in the form of the relationship between the width of the amorphous alloy thin tape and the ratio ($P_o/P$) of the core loss $P_o$ of the toroidal cores of the comparative example and the core loss P of the toroidal cores of the embodiment, using amorphous alloy thin tape of the same width.

As can be seen from this figure, there is a marked lowering of core loss when amorphous alloy thin tape of width greater than 10 mm is used. The lowering of core loss increases with increased width of the amorphous alloy thin tape.

EMBODIMENT 5

Amorphous alloy thin tape of a plurality of different types was manufactured, in which the difference in sheet thickness in the width direction was varied by altering the tape manufacturing conditions, using the single roll method and employing alloy having the composition represented by:

$$(Co_{0.91}Fe_{0.93}Mn_{0.04}Nb_{0.02})_{74}Si_{14}B_{12}.$$

The width of the thin tape was 25 mm.

Next, these amorphous alloy thin tapes were divided into two in the lengthwise direction and rolled faces (or free faces) were superimposed, and wound-up bodies of external diameter 60 mm×internal diameter 40 mm were produced by simultaneously winding up these two tape layers on a winding jig to the required shape.

Next, toroidal cores were manufactured by performing heat treatment under the conditions 440° C., 40 minutes on these wound-up bodies.

Also, using the respective amorphous alloy thin tapes of the plurality of different types, of different sheet thickness difference, used in the above embodiment, respective toroidal cores were manufactured in the same way, except that the wound-up body was formed by winding only one tape layer of amorphous alloy thin tape.

Figure 4:
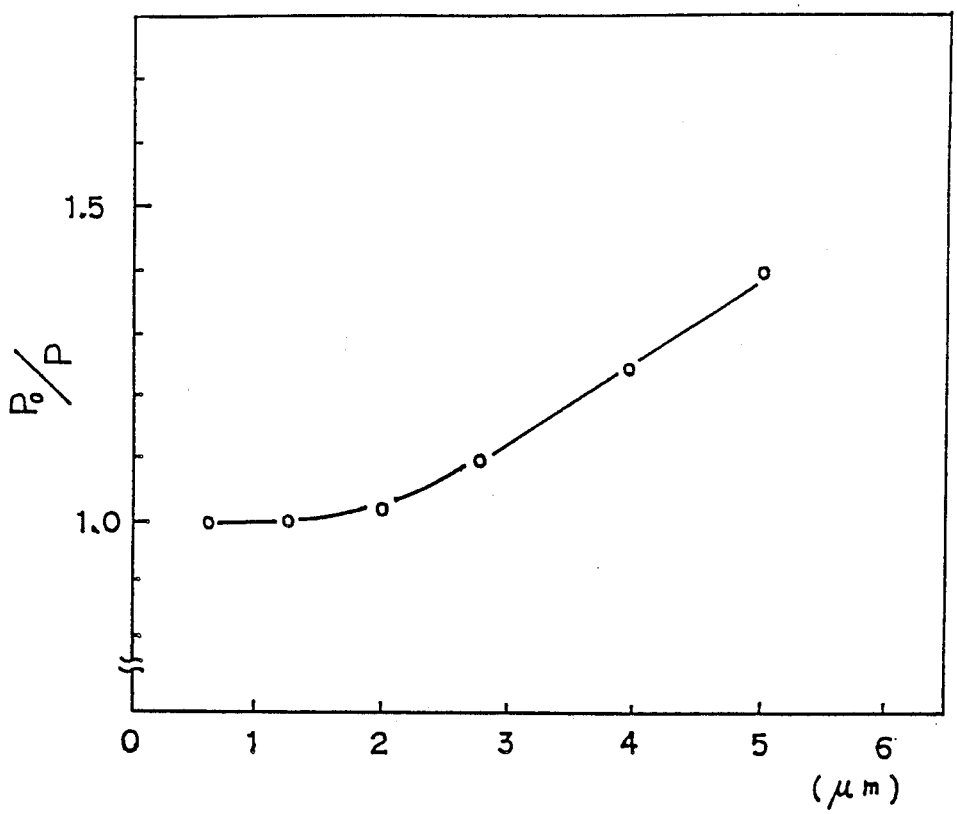
FIG. 4 is a graph showing the relationship b sheet thickness difference of amorphous alloy thin tape of toroidal cores manufactured in accordance with an embodiment of the invention and the core loss ratio of toroidal cores manufactured by winding a single tape layer, using thin tape of the same sheet thickness difference.

Using the toroidal cores of these embodiments and comparative examples, the core loss was measured under the conditions f=100 kHz, B=0.1 T. The results are shown in FIG. 4, in terms of the relationship between the difference of sheet thickness of the amorphous alloy thin tape and the ratio ($P_o/P$) between the core loss $P_o$ of the toroidal cores of the comparative examples and the core loss P of the toroidal cores of the embodiments, when amorphous alloy thin tape of the same sheet thickness difference was used.

As is clear from this figure, the benefit in terms of core loss reduction is particularly marked when amorphous alloy thin tapes whose difference in sheet thickness in the width direction is at least 2 μm are used. Also, it can be seen that the benefit is increased as the difference in sheet thickness in the width direction of the amorphous alloy thin tape increases.

As described above, according to this invention, a wound-up body of excellent dimensional accuracy on both sides in the width direction of the metal thin tape is obtained. Consequently, the stress distribution over the whole wound up body is uniform, and a magnetic core having small core loss and excellent magnetic properties can be obtained.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents.

What is claimed is:

1. A magnetic core having a wound-up laminated body of at least two thin magnetic tapes, said magnetic tapes wound together in contacting relationship along the length thereof, each of said magnetic tapes having a thickness which varies across its width, the thickness of contacting adjacent tapes varying oppositely across their widths so that the thickness of the wound-up laminated body at the two ends in the width direction is substantially equal.

2. A magnetic core according to claim 1 wherein said thin tapes are Fe-based amorphous alloy.

3. A magnetic core according to claim 1 wherein said thin tapes are Co-based amorphous alloy.

4. A magnetic core according to claim 1 wherein said thin tapes are a soft magnetic alloy having fine crystal grains of about 50 Å to 300 Å.

5. A magnetic core according to claim 1 wherein said thin tapes have a sheet thickness difference between the two ends in the width direction of at least 2 μm.

6. A magnetic core according to claim 1 wherein said thin tapes have a width of at least 10 mm.

7. A magnetic core according to claim 1 wherein said thin tapes have a thickness in the range 10 μm to 50 μm.

8. A magnetic core according to claim 1 wherein the number of wound-up layers of said wound-up laminated body is at least 50.

* * * * *